United States Patent [19]

Brown

[11] 4,365,926

[45] Dec. 28, 1982

[54] FREE-HANGING LOAD CARRIER FOR BOOM, WITH BRAKE

[75] Inventor: Wilburn K. Brown, Morton Grove, Ill.

[73] Assignee: Pettibone Corporation, Chicago, Ill.

[21] Appl. No.: 755,051

[22] Filed: Dec. 28, 1976

[51] Int. Cl.[3] ..... B66C 1/24

[52] U.S. Cl. ..... 414/685; 182/2; 212/259; 414/694

[58] Field of Search ..... 214/777, 769, 131 R, 214/140, 770, 138 R; 182/2; 212/9, 58 R, 59 R, DIG. 1

[56] References Cited

U.S. PATENT DOCUMENTS

| | | | |
|---|---|---|---|
| 3,043,394 | 7/1962 | Holl | 182/2 |
| 3,196,979 | 7/1965 | Garnett | 182/2 |
| 3,411,606 | 11/1968 | Oldakowski et al. | 182/2 |
| 3,498,474 | 3/1970 | Pierce, Jr. | 182/2 |
| 3,908,843 | 9/1975 | Noller et al. | 214/138 R |

FOREIGN PATENT DOCUMENTS

| | | | |
|---|---|---|---|
| 2166785 | 2/1976 | Fed. Rep. of Germany | 182/2 |

*Primary Examiner*—Richard A. Bertsch
*Assistant Examiner*—Ross Weaver
*Attorney, Agent, or Firm*—Louis Robertson

[57] ABSTRACT

The use of a lift fork for a boom swinging vertically over 240° is made feasible by hanging the lift fork with freedom to pivot as gravity dictates when the angularity of the boom is changed, with a brake by which the angularity between boom and lift fork can be locked. The brake enables the boom to exert a strong forward thrust on the bottom of the lift fork when this is necessary for thrusting its tines under a load, and has other advantages. Proper positioning of the load on the forks will cause the forks to hang with the tines of the forks nearly level, or slightly tilted back if preferred. Prefably the fork-lift device also hangs conveniently close to this position when empty. Material handling programs which heretofore needed not only a crane operator but a crew for attaching the hoist line to the load and removing it, can be performed by the operator alone if the swinging but lockable lift fork is used with a three-part "reach anywhere" articulated boom on a swinging crane.

4 Claims, 2 Drawing Figures

FREE-HANGING LOAD CARRIER FOR BOOM, WITH BRAKE

INTRODUCTION

The invention of which the present disclosure is offered for public dissemination in the event adequate patent protection is available relates to load-carrying devices typified by the lift fork of a boom-type of loader. In another sense the invention relates to a new utility for a three-part articulated boom achieved by making a lift fork for such a boom practical in spite of the wide angularity of movement that it must have with respect to the boom-part by which it is carried and manipulated.

With a three-part articulated boom, the forward section or boom-part of the boom may well swing through a vertical angularity considerably in excess of 180°. Providing such a boom with a fork device or bucket controlled in the usual manner, by a hydraulic cylinder, would seem to be virtually impossible. Buckets usually need to be tilted up and down under control; and a lift fork usually needs to have its tines kept horizontal throughout the angular movement of the boom-part. To remain level, its angular movement with respect to that boom-part must be equal to the vertical angular movement of that boom-part. With the usual simple control by hydraulic cylinder of the angularity of the fork with respect to its boom-part, it is not practical to have the relative movement between them even approach 180°.

According to the present invention, the wide angularity of relative movement between the fork or other load carrier and its boom-part is achieved by letting the carrier hang freely from its boom-part, with a pivotal connection, and so balanced that the carrier hangs in an acceptable condition, such as with its tines horizontal, throughout the wide angularity of movement of the associated boom-part.

For those occasions when a locked relationship is desired or might even be necessary, a brake is provided. Thus a fork device can be carried in keyed relationship with the disc of a disc brake system so that when the operator desires to prevent the usual free pivoting action, he can apply pressure on a brake pedal which will actuate a hydraulic brake unit to seize the disc, thereby locking the lift fork in its then angularity to the boom-part. This will permit, for example, the manipulation of the boom-part to apply thrust to the tines of the lift fork to thrust them under a load.

Additional advantages of the invention will be apparent from the following description and from the drawings.

DESIGNATION OF FIGURES

DESCRIPTION OF THREE-PART BOOM CRANE

Figures 1, 2:
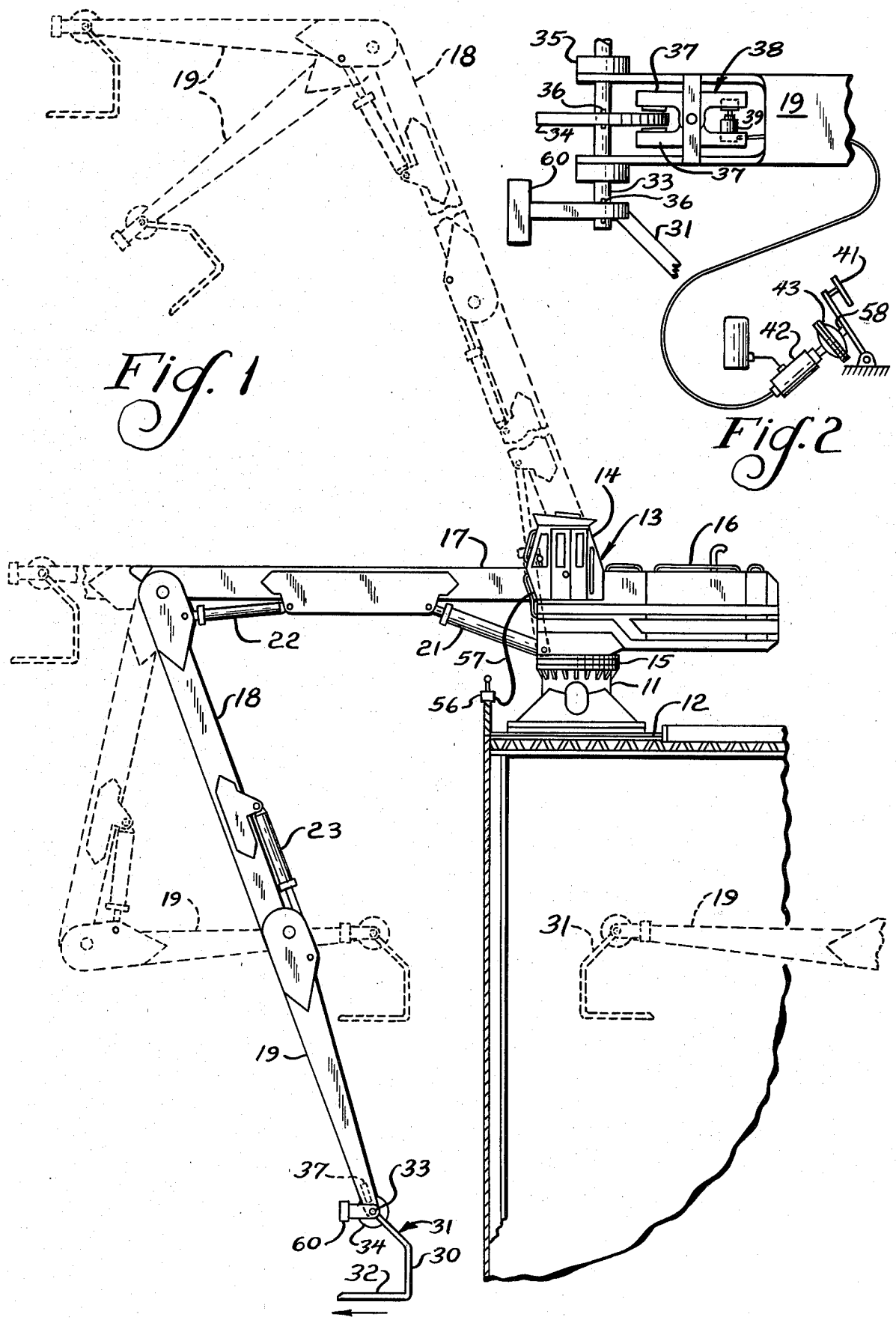
FIG. 1 is a somewhat diagrammatic side elevational view of a three-part boom crane, swing-mounted on a ship shown fragmentarily in cross section, with different boom positions shown in broken lines, and with a lift fork according to the present invention added thereto.
FIG. 2 is a somewhat diagrammatic illustration of the brake applying features of the present invention, shown in conjunction with a fragment of the forward boom-part of FIG. 1; the keyed relationship of the brake disc to the lift fork (fragmentarily shown) being indicated.

Inasmuch as the greatest utility of the present invention may well be in connection with the three-part boom crane of a pending prior application of the present applicant, that crane has been illustrated in FIG. 1 and is here briefly described.

The crane base 11 is shown mounted on a ship deck 12. A main crane body 13 including a cab 14 is carried by a powered turntable 15. An engine 16 provides power and also serves as a counterweight. A rear boom-part 17, sometimes called the shipper, carries an intermediate boom-part 18 articulated to it to swing downwardly, and this in turn carries a forward boom-part 19, also articulated to it to swing in the direction that is downward when the intermediate boom-part 18 is horizontal. The primary boom-part 17 can be raised and lowered between its full line position and its broken line position as seen in FIG. 1 by hydraulic cylinder 21. Hydraulic cylinders 22 and 23 control the vertical swinging at the other articulated joints. Preferably all movements can be controlled hydraulically by valve handles in cab 14 or by a portable remote control unit 56.

DESCRIPTION OF THE PRESENT INVENTION

Whereas the crane of the prior application used a hoist line, the present invention contemplates equipping it instead with a load supporting device such as the hanging lift fork device 31. Theoretically a bucket or scoop similar to those used on front-end loaders, except hanging, could be provided instead, but the occasions for use of a hanging scoop are believed to be relatively rare. Hence the description will refer to lift forks.

On front-end boom and lift fork machines, lift forks have for many years been controlled in their angularity with respect to the boom by a hydraulic cylinder. Because the angularity through which the boom would swing vertically was commonly less than 90°, there was rarely any need or desire for having more than approximately a 90° variation of angularity between the load supporting device and the boom. This amount of movement, angularly, could be quite satisfactorily controlled by a hydraulic cylinder.

With the three-part articulated boom illustrated in FIG. 1, however, the vertical angular movement of the forward boom-part 19 is well over 240°. Only about 180° is illustrated in the drawing, between the broken line position shown at the lower left of FIG. 1 and the broken line position shown at the upper right of FIG. 1. However, it is apparent from the full-line position of forward boom-part 19 in FIG. 1 that it can be extended into alignment with intermediate boom-part 18. Hence if the boom-part 19 were raised from its position at the upper left of FIG. 1 into alignment with the upwardly extending boom-part 18, this would add a little more than 60° to its vertical swinging movement, making a total swing of about 240°. Furthermore, somewhat more could be added in the opposite direction by maintaining the angularity illustrated in broken lines between the parts 18 and 19 at the lower left of FIG. 1 while the part 18 was swung to its full-line position.

Such an extended vertical swing of the forward boom-part 19 necessarily means that if a fork device is carried by it there must be an equal swing between the fork device and the forward boom-part 19, if the tines of the fork device are to remain level. The contemplated 240° or more is a far greater vertical angularity of movement relative to its associated boom-part than can be handled by the simple hydraulic cylinder systems such as have been used heretofore for tilt control of forks, buckets and the like. Until the present invention, this has discouraged the use of lift forks with booms in which the boom-part carrying the device would have a vertical swing of even as much as 180°, or substantially beyond 90°. Such booms have therefore seemed to require hoist lines, in spite of their well known lack of efficiency as compared to forks. Cranes, in general, have had to tolerate the poor efficiency of hoist lines because without articulated booms, they could not otherwise reach the wide variety of load locations that must be serviced.

According to the present invention, the use of lift forks is made practicable by constructing and mounting the fork structure with supporting overhead extensions in such manner that it ordinarily hangs for free-swinging movement with respect to its boom-part; but providing a brake for locking it against angular movement with respect to its boom-part whenever desired. The free-swinging part of this alone would not be satisfactory for a hanging lift fork, because it is often necessary to exert considerable force on the tines in a substantially horizontal direction in order to force them under a load to be picked up, or to drag them out from under a load which has been set down. The combination of the free swinging and the brake, however, together with proper balancing of the load-supporting device so that it will keep its tines 32 substantially level while free swinging, accomplishes the conflicting needs of providing all of the angular movement needed while making possible the exertion of thrust on the tines, substantially in the horizontal direction, when that is needed.

The structure providing the combination of free swinging, normally, and braking when desired, can be quite simple. Thus as seen in FIG. 1 the fork device 31 can hang by supporting extensions 30 from a shaft 33 which extends pivotally through the boom-part 19 as seen better in FIG. 2, and which may be carried by bearings 35. The shaft 33 carries a brake disc 34. The illustration of keys 36 indicates that the brake disc 36 and fork device 31 are both nonrotatively mounted as to shaft 33, so that as the fork device 31 swings, the disc 34 will swing likewise.

As seen in FIG. 2, the disc 31 swings between the jaws 37 of a hydraulic brake 38 actuated by a hydraulic cylinder 39 to squeeze the disc 36 firmly when desired. Of course, the jaws 36 are provided with friction shoes, according to common brake practice. The hydraulic cylinder 39 may be controlled by brake pedal 41 which has been illustrated as actuating a master brake cylinder 42 with the aid of a power booster unit 43. Of course the brake system could be a full-power system instead of a power-boosting system, if desired. However, some "feel" is desired similar to that in power-boosted brakes because there are times when a controlled partial relaxation of the braking force is desired. For example, if a load is not seated far enough back on the tines 32 and as a result there is danger that the load might slip off, this danger can be removed, if the lifting swing is in the direction the tines point, by applying a light braking action to pedal 41. The operator's feel will help him to apply just the right amount of braking action to apply a slight drag between the brake jaws 37 and the disc 34 to raise the tips of the tines 32 the amount required to keep them level or slightly higher at the tips.

Likewise, in forcing the tines 32 under a load, the tines will be gradually tipped upwardly as the penetrating movement continues. However, the brake can be released just enough to let the tines swing back to the level condition for further entry under the load.

Although the combination of free-swinging normally, together with braking when desired, is especially advantageous for booms having an angle of vertical swing that is very large, or at least too large for operation by a cylinder, this combination may also prove to be useful with booms of the limited vertical swings which are now more common. When a tilt cylinder is used as heretofore, it is necessary to keep supplying just the right amount of hydraulic fluid to the hydraulic cylinder to compensate for the swinging action of the boom in order to keep the tines level (if keeping them level is desired). This either requires some additional automatic mechanism, or great care and some skill on the part of the operator. With the present invention, if the load is properly balanced, the tines will hang level regardless of the varying angularity of the boom-part 19, so long as the brake is not applied. Furthermore, it is expected that the brake discs and hydraulic cylinder system will be less expensive and more trouble-free than a tilt cylinder with its necessary valving and pump supply. Even the hydraulic tubing can be less costly because the brake can be actuated and relaxed by a very small flow through the tubing and the hydraulic pressure does not need to be as high as has been common with tilt cylinders.

One condition under which full power braking may be preferred to the booster power braking illustrated is if the crane is to be operated by remote control. There are already remote control systems available in which an operator carries on his chest a small remote control unit 56 which has a cluster of master cylinders each connected by a slim tube in an umbilical cord 57 to a corresponding slave cylinder in the crane body 13 which actuates the usual reversing valves which would otherwise be operated by hand levers in the cab 14. If that remote control system is used, the hydraulic brake 38 could be controlled in a similar remote-control manner. Although theoretically an additional master cylinder 56 of the remote cluster could operate a brake plunger such as plunger 58 of FIG. 2 through its slave cylinder, it is likely to prove more desirable to have this slave cylinder control a full-power brake system instead. The arrangement should preferably be such that the hand could be removed from the brake control lever on remote control unit 56 while leaving the brake fully applied, or totally relaxed, at will.

BALANCE OF LIFT FORK

The supporting extensions 30 of the lift fork 31 are shaped to locate their eye-engaging shaft 33 over the expected load-center on tines 32. This will be near the midlength of the tines, but experience may show that some departure therefrom is more convenient. The extensions 30 upwardly from the tines can be relatively thin transversely and elongate in the direction parallel to the tines, in cross-section, to have strength with the least attainable weight, so that the empty fork will hang with tines 32 only slightly high at the tips. By moving its tips against a load about to be lifted, the fork can easily be leveled before the brake is applied to hold it that way. If this proves to be inconvenient, a counterbalance weight 60 could be positioned forwardly of the pivotal region to make the empty tines horizontal. Theoretically, the tips of the tines could be weighted, but slimness may be deemed more desirable to slip under a load.

ACHIEVEMENT

With the present invention, it becomes entirely feasible to equip a three-part articulated boom, or any other boom in which the forward boom-part has a very wide angle of vertical swinging, with a load-supporting device such as a lift fork. The combination of a reach-anywhere articulated boom and a fork lift carried by it enables a single crane operator to load and unload palletized material or the like without the additional crew required for attaching the hoist line at one location (as on the dock) and for disconnecting it at another location (as in the hold of a ship). With the remote control unit, the crane operator can walk to the ship rail for observing the action he controls on the dock, and walk to the edge of the hatch for observing the action he controls within the hold.

Even without the three-part articulated boom, the hanging lockable lift fork may be found preferable on some occasions to cylinder-control of the lift fork. It may be more convenient, and may even be more stable because the swing, which an operator may allow to occur upon stopping or starting movement of a loaded lift fork, tends to be in a load-retaining direction.

Although the above disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

The disclosure of applicant's application Ser. No. 664,268 is incorporated herein by reference, and the benefit of its filing date for common subject matter is claimed. The hoist line features of that application could be applied to the boom alternately with the lift fork of the present invention; or conceivably both could be on the boom simultaneously.

I claim:

1. Material-handling apparatus including a boom-part and a lift fork hanging from the end thereof, and power means for manipulating the boom-part during use with a vertical angular swing substantially exceeding 180°;

said lift fork being a rigid structure including tines for slipping under a load and extensions to a point above a mid-zone of the tine length at which the fork is pivotally suspended from the boom-part; a brake disc angualarly locked to the lift fork and pivotal about the pivotal axis thereof; and braking means carried by the boom-part and operable by remote control for quick application at will for seizing the brake disc to lock the load carrier firmly to the boom-part at any one of a wide variety of angularities with respect thereto during material handling, and for quick full release to allow the load carrier to hang naturally.

2. Material handling apparatus including a rear boom-part pivoted at its base about a horizontal axis to swing vertically, an intermediate boom-part pivoted at one end to the forward end of the rear boom-part about a horizontal pivot, and a forward boom-part pivoted at one end to the forward end of the intermediate boom-part; hydraulic cylinder means for each boom-part for pivoting it about its horizontal pivot, with the full force of the hydraulic means applied directly to the boom-part; with the forward boom-part having a total vertical swing during use through over 240° and a lift fork hanging from the front end of the forward boom-part;

said lift fork being a rigid structure pivotally suspended from the boom-part and balanced to hang therefrom with its tines approximately horizontal when suitably loaded, and conveniently close to horizontal when empty; a brake disc angularly locked to the lift fork and pivotal about the pivotal axis thereof, and braking means carried by the boom-part and operable by remote control for quick application at will for seizing the brake disc to lock the lift fork to the boom-part at any one of a wide variety of angularities with respect thereto throughout the range of vertical swinging of the forward boom-part, during material handling, and for quick full release to allow the load carrier to hang naturally.

3. Material-handling apparatus including a boom-part, power means for manipulating the boom-part during use with a vertical angular swing substantially exceeding 180° and including a swing through a downwardly extending vertical position, and a load carrier carried by the end of the boom-part that is its bottom end in said position; said load carrier being a rigid structure and having a slim bottom designed to be thrust under a load by the swing of the boom-part through said position;

said load carrier being hung from the boom part with a pivotal connection above a mid-zone of the front-to-back length of the bottom to hang in a load-retaining position; its bottom in that position being substantially horizontal and of substantial front-to-back length; a brake disc angularly locked to the load carrier and pivotable about the pivotal axis of said connection; and braking means carried by the boom-part and operable by remote control for quick actuation at will for seizing the brake disc to lock the load carrier firmly to the boom-part to be thrust under a load by the boom-part's swing through said position, and to lock the load carrier firmly to the boom-part at any one of a wide variety of angularities with respect thereto during material handling, and operable for quick full release to allow the load carrier to hang naturally.

4. Material-handling apparatus including a boom-part, power means for manipulating the boom-part during use with a vertical angular swing substantially exceeding 90° and including a swing through a position extending steeply downward, and a load carrier carried by the end of the boom-part that is its bottom end in said position; said load-carrier being a rigid structure and having a slim bottom designed to be thrust under a load by movement of the boom-part through said position;

said load carrier being hung from the boom-part with a pivotal connection having its axis above a mid-zone of the front-to-back length of the bottom to hang in a load-retaining position; its bottom in that position being substantially horizontal and of substantial front-to-back length; a brake disc angularly locked to the load carrier and pivotal with it about said axis; and braking means carried by the boom-part and operable by remote control for quick application at will for seizing the brake disc to lock the load carrier firmly to the boom-part to be thrust by it under a load as it is moved through said position, and to lock the load carrier firmly to the boom-part at any one of a wide variety of angularities with respect thereto during material handling, and operable for quick full release to allow the load-carrier to hang naturally.

* * * * *